United States Patent [19]

Held

[11] Patent Number: 4,696,232

[45] Date of Patent: Sep. 29, 1987

[54] DETONATOR SAFETY DEVICE FOR A WEAPON

[75] Inventor: Manfred Held, Aresing, Fed. Rep. of Germany

[73] Assignee: Messerschmitt-Boelkow-Blohm Gesellschaft mit beschraenkter Haftung, Munich, Fed. Rep. of Germany

[21] Appl. No.: 799,407

[22] Filed: Nov. 19, 1985

[30] Foreign Application Priority Data

Nov. 28, 1984 [DE] Fed. Rep. of Germany ..... 3443331

[51] Int. Cl.[4] ..... F42C 15/34

[52] U.S. Cl. ..... 102/254; 102/202.1; 102/428

[58] Field of Search ..... 102/428, 429, 254, 202.1, 102/202.14

[56] References Cited

U.S. PATENT DOCUMENTS 2,891,477 6/1959 Swanson ..... 102/202.6

FOREIGN PATENT DOCUMENTS

| | | | |
|---|---|---|---|
| 0722439 | 7/1942 | Fed. Rep. of Germany | 102/428 |
| 1110557 | 7/1961 | Fed. Rep. of Germany | 102/429 |
| 2360226 | 4/1980 | Fed. Rep. of Germany . | |
| 3017785 | 5/1980 | Fed. Rep. of Germany . | |
| 0045037 | 2/1939 | Netherlands | 102/429 |
| 0014912 | of 1906 | United Kingdom | 102/254 |
| 2118282 | 10/1983 | United Kingdom . | |

*Primary Examiner*—Stephen C. Bentley
*Assistant Examiner*—Stephen M. Johnson
*Attorney, Agent, or Firm*—W. G. Fasse; D. H. Kane, Jr.

[57] ABSTRACT

A detonator safety device for a weapon, such as an artillery shell or a war head, includes a detonator member, a detonator charge and an igniter plate for applying a firing impact with the aid of the igniter plate on a main explosive charge of the weapon in response to the firing of the detonator charge by the detonator member when the device is in a firing position. The arrangement is such, that the main explosive charge cannot be fired by the igniter plate when the device is in a safety position even if the detonator charge should accidentally be fired.

8 Claims, 11 Drawing Figures

DETONATOR SAFETY DEVICE FOR A WEAPON

FIELD OF THE INVENTION

The invention relates to a detonator safety device for a weapon, especially for a war head including a main explosive charge. The safety device itself includes a detonator member for firing a detonator charge which in turn transmits a firing impact with the aid of an igniter plate to the main explosive charge when the safety device is in its firing position. In the firing position the detonator member, the detonator charge, the igniter plate, and the main explosive charge form the so-called firing chain by their series arrangement.

DESCRIPTION OF THE PRIOR ART

The storing of conventional weapons such as war heads, artillery shells, and the like poses a substantial safety problem because a fire in or of the storage facility causes a substantial danger that the weapons may explode. As a result, it was customary heretofore to use, at least for the main explosive charge of such weapons, a relatively nonsensitive explosive material that, in case of fire, would burn relatively slowly rather than with a violent explosion. With this type of nonsensitive explosive materials it was possible heretofore to avoid partial, or even complete sudden detonations. However, the disadvantage of using such relatively nonsensitive explosive material is seen in that the main explosive charge requires a very forceful firing impact or initiation over a larger surface area for achieving a detonation at all. In other words, substantial detonator charges were needed for producing the required firing impact.

German Patent (DE-PS) No. 3,017,785 has addressed this problem by igniting the main explosive charge with the aid of a separate detonator charge causing the firing impact on the main explosive charge by hurling an igniter plate against the main explosive charge. The igniter plate forms a firing or detonator wave which ignites the main explosive charge in a desired pattern. It is possible to achieve a desired detonator wave pattern by varying the shape of the igniter plate and/or the surface configuration of the main explosive charge as well as the spacing between the igniter plate and the surface of the main explosive charge. There is no teaching in this prior art that the location of the igniter plate in the safety position of the detonator safety device could be utilized to guard against igniting the main explosive charge, for example, in a fire.

OBJECTS OF THE INVENTION

In view of the foregoing it is the aim of the invention to achieve the following objects singly or in combination:

to modify a conventional detonator safety device in such a manner that in its safety position it provides an additional safety feature when the weapon should happen to be exposed to high temperatures, for example, in a fire.

to locate the igniter plate in its safety position in such a way, that it will protect the main explosive charge;

to arrange the detonator member, the detonator charge, and the igniter plate in such a way that they may be shifted or rotated from a safety position into a firing or armed position, whereby in the safety position a safe spacing is provided between the detonator and the main explosive charge; and to locate a removable material between the igniter plate and the surface of the main explosive charge for protecting the main explosive charge against an accidential ignition, for example, if the detonator charge should explode in case of a fire.

SUMMARY OF THE INVENTION

The detonator safety device according to the invention is characterized in that in the safety position the igniter plate is spaced from the detonator charge to such an extent that the spacing is sufficient to prevent the formation of a detonator wave that could ignite the main explosive charge of the weapon in case the detonator charge is ignited accidentally. Preferably, the igniter plate in its safety position rests against the main explosive charge for protection. However, the igniter plate may also be spaced in the safety position from the main explosive charge as well as from the detonator charge. Where the igniter plate is spaced from the main explosive charge, it is preferable to fill the space resulting from such spacing with a removable medium or material that will provide an additional safety factor. In a modified embodiment the igniter plate either alone or in combination with the detonator charge, is movable either by rotation and/or by shifting out of the safety position providing the above mentioned spacing, into the armed or firing position in which the respective spacing is substantially reduced to make the igniter plate effective for firing the main explosive charge.

The detonator member itself may either be rotatable or shiftable from the safety position into the armed or firing positon and vice versa. Similarly, the detonator charge could be rotated and/or shifted by itself from a safety position into an armed or firing position in which its effective direction is directed toward the main explosive charge. The igniter plate is made of a nonexplosive material.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1A:
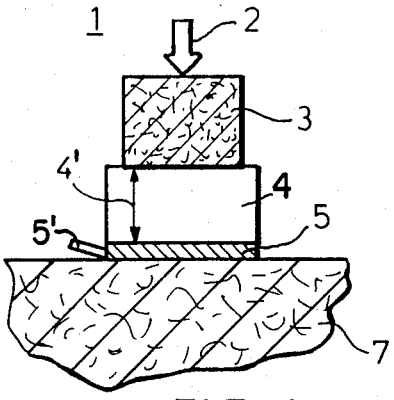
FIG. 1*a* illustrates a sectional view through a detonator safety device of the invention with its igniter plate in the safety position.
Figure 1B:
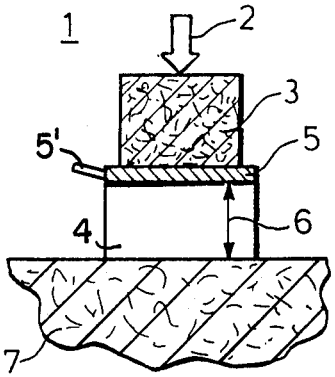
FIG. 1*b* shows the embodiment of FIG. 1*a* with the igniter plate in the firing position.

Referring to FIGS. 1*a* and 1*b*, the present safety device 1 comprises a detronator member 2, a detonator charge 3, a mounting member 4, and an igniter palte 5. The components 2, 3, 4, and 5 are arranged in a housing not shown. In the safety position of FIG. 1*a* the igniter plate 5 rests on a main explosive charge 7 in a position spaced by a spacing 4' from the detonator charge 3. A handle 5' permits shifting the igniter plate 5 into the firing position or armed position shown in FIG. 1*b*, whereby the igniter plate 5 is spaced from the main explosive charge 7 by a spacing 6. The mounting member 4 is provided with conventional means not shown for holding the igniter plate 5 with a sufficiently tight fit in the illustrated end positions. In operation, the spacing 4' between the igniter plate 5 and the detonator charge 3 in the safety position is so selected that any accidental detonating of the detonator charge 3 will not be able to generate a sufficient compression force or wave for hurling the igniter plate 5 against the main explosive charge 7 to fire the main explosive charge. In other words, with the igniter plate 5 in the position shown in FIG. 1*a*, the main explosive charge will not be fired even if the detonator charge 3 should accidentally be ignited. On the other hand, in FIG. 1*b* the spacing 6 is such, that an ignition of the detonator charge 3 by the detonator member 2 generates a sufficient compression wave which hurls the igniter plate 5 against the main explosive charge 7 with such a force, that the latter explodes. Thus, in the safety position shown in FIG. 1*a*, the igniter plate 5 actually forms a damping element for any accidental impact load on the main explosive charge 7. Hence, the plate 5 performs not only its primary igniter function, but also a protecting function.

Figure 2A:
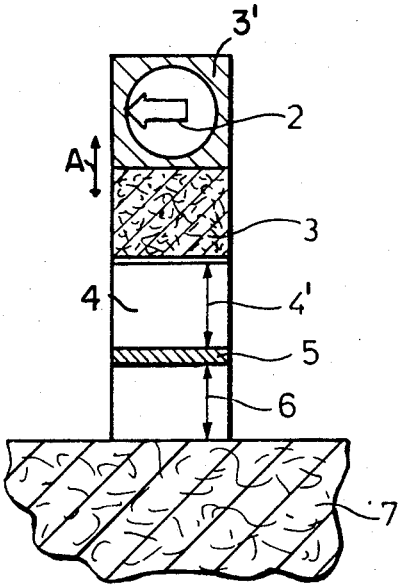
FIG. 2*a* shows a sectional view through a modified embodiment of a detonator safety device in which the igniter plate is spaced from the detonator charge and from the main explosive charge in the safety position.

In the embodiment of FIG. 2*a* the igniter plate 5 is held by the mounting member 4 in an intermediate position between the detonator charge 3 and the main explosive charge 7, again with the above mentioned spacings 4' and 6. In order to arm the weapon the detonator member 2 is rotated counterclockwise from the position shown in FIG. 2*a* into the position shown into the position 2*b*, whereby simultaneously the unit formed by the detonator charge 3 and its carrier member 3' is shifted downwardly from the position of FIG. 2*a* into the position of FIG. 2*b*. The means for performing this shifting are conventional and are indicated by the double arrow A which signifies that the unit 3, 3' may also be shifted back into the safety position of FIG. 2*a*. The rotation of the detonator member 2 and the shifting of the unit 3, 3', may be coupled so that cuasing one motion also causes the other motion or vice versa.

Figure 2B:
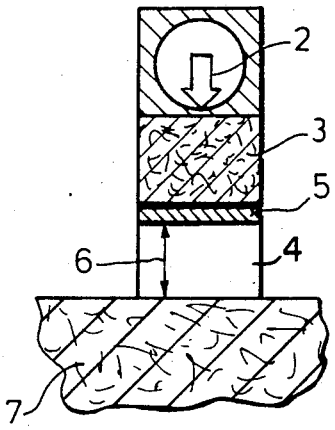
FIG. 2*b* shows the embodiment of FIG. 2*a* in the armed or firing position.
Figure 3A:
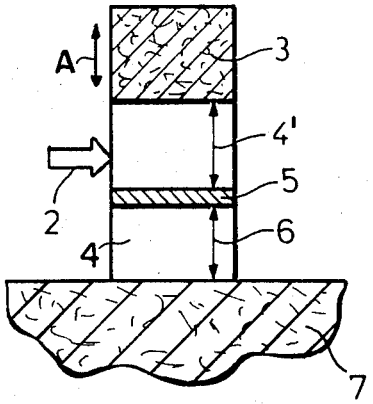
FIG. 3*a* shows a sectional view through a detonator safety device in its safety position similar to the embodiment of FIG. 2*a;*
Figure 3B:
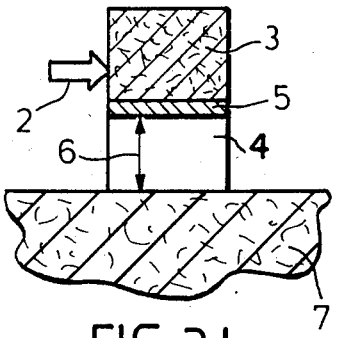
FIG. 3*b* shows the embodiment of FIG. 3*a* in its firing condition.

The embodiment shown in FIGS. 3*a* and 3*b* is similar to that of FIGS. 2*a* and 2*b*, except that in FIGS. 3*a* and 3*b* the detonator member 2 remains in the same location in the embodiment of FIGS. 3*a* and 3*b*. Thus, the detonator charge 3 is shiftable up and down as indicated by the arrow A between the safety position and the firing position or vice versa. The igniter plate 5 is again mounted by a mounting member held in place in a housing of the weapon not shown. In the position of FIG. 3*b* representing the armed or firing condition the detonator charge 3 is ready for cooperation with the detonator member 2, while in FIG. 3*a*, in the safety condition, such cooperation is prevented.

Figure 4A:
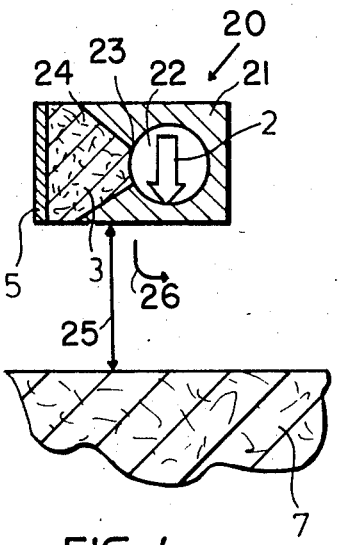
FIG. 4*a* shows a sectional view through a further embodiment of a detonator safety device according to the invention in which a mounting member forms a unit with the detonator charge and the igniter plate.
Figure 4B:
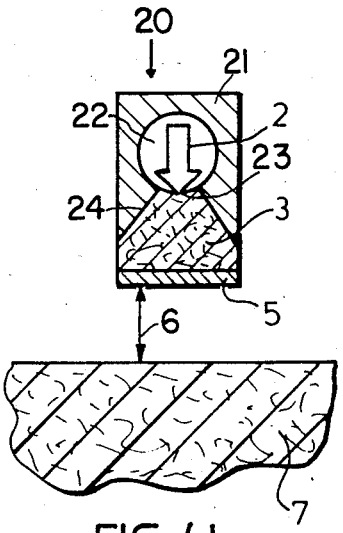
FIG. 4*b* shows the embodiment of FIG. 4*a* with the detonator unit in the firing position.

In the embodiment of FIGS. 4*a* and 4*b*, the detonator member 2 is mounted in a fixed position and the detonator unit 20 comprises a mounting body 21 having an opening 22 communicating at 23 with a conical recess 24 holding the detonator charge 3 to which the igniter plate 5 is secured, for example, by an adhesive or the like. In the safety condition shown in FIG. 4*a* the spacing 25 is sufficient to prevent in combination with the safety location of the igniter plate 5, an accidental firing of the main explosive charge 7. In order to arm the weapon, the detonator unit 21 is rotated counterclockwise as indicated by the arrow 26, and as viewed from the position of the viewer, from the safety position of FIG. 4*a* into the armed or firing position of FIG. 4*b* in which the detonator member 2 is effective through the interface 23 between the opening 22 and the conical recess 24 to ignite the detonator charge 3. In this embodiment the detonator member 2 is always located in a fixed position and directed in the direction in which the detonator unit 21 is effective. The means for tilting the unit 21 are conventional and hence not shown in detail. For example, the body 21 could be located with a sufficiently tight fit on a tilting shaft fitting into the opening 22. If the detonator charge 3 in its safety position of FIG. 4*a* should accidentally be ignited, it force can easily be dissipated through an opening in the housing of the weapon not shown.

Figure 5A:
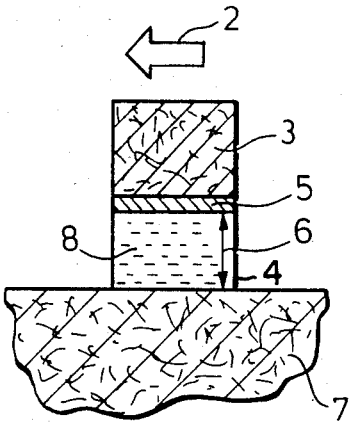
FIG. 5*a* shows a sectional view through an embodiment in its safety condition in which a space between the main explosive charge and the igniter plate is filled with a removable safety material.
Figure 5B:
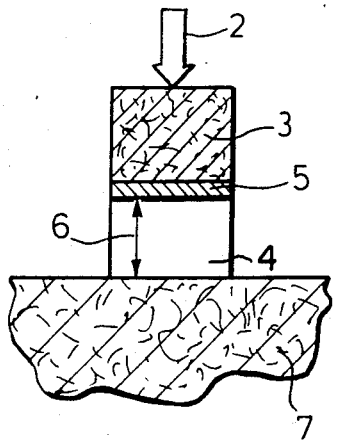
FIG. 5*b* is a view similar to that of FIG. 5*a*, with the safety material removed, bringin the device into the firing condition.

In the embodiment shown in FIGS. 5*a* and 5*b* the detonator member 2 is rotatable from its safety position of FIG. 5*a* into the armed position of FIG. 5*b* and vice versa. Further, the spacing 6 between the main explosive charge 7 and the igniter plate 5 provides a space 8 which in this embodiment is filled with a flowable material such as, sand, or a liquid, or pellets, or the like. An opening in the housing permits removal of the flowable material from the space 8 to bring the detonator into the firing condition as shown in FIG. 5*b*.

Figure 6:
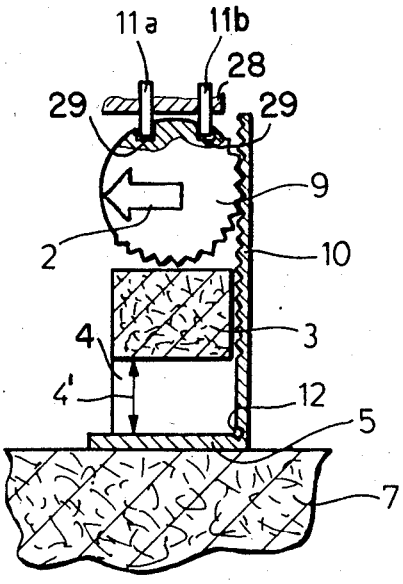
FIG. 6 is a sectional view of a further embodiment in which the rotation of a detonator member is coupled with the shifting of the igniter plate from the shown safety position into a firing position.

FIG. 6 shows an embodiment similar to that of FIGS. 1*a* and 1*b* in which the igniter plate 5 rests on the main explosive charge 7 in the safety position. An operative connection such as a rack and pinion device 9, 10 couples the igniter plate 5 to the movement of the detonator member 2 which is connected by the pinion gear 9 and by the toothed rack 10 to the igniter plate 5. Preferably, a weak point or line 12 interconnects the plate 5 with the toothed rack 10 so that upon firing of the detonator charge 3 the plate 5 will be severed from the rack 10 at the point or line 12 whereby the plate 5 may be hurled with the sufficient force against the main explosive charge 7.

In the safety position shown in FIG. 6 the rotation of the pinion 9 as indicated by the arrow 27 is possible only when both safety pins 11*a* and 11*b* are retracted into the housing 28 out of the recesses 29 in the pinion 9 for permitting rotating the detonator member 2 into the firing position in which the detonator member 2 would point toward the detonator charge 3 with the plate 5 resting against the lower surface of the detonator charge 3. The rotation of the pinion 9 may, for example, be accomplished with a spring motor or with an electric motor, or even manually.

The special advantage of the detonator safety device according to the invention is seen in that the main explosive charge may now be of the type which is rather nonsensitive to a heat exposure and that rather sensitive detonator charges may be employed for hurling the igniter plate 5 against the main explosive charge. The device is very simple, yet quite safe in case that the weapon should be exposed to high heat, for example, in a fire whereby a partial or total prevention of an ignition of the main explosive charge is assured even though fire sensitive or rather heat sensitive components form part in the detonator or ignition chain.

Although the invention has been described with reference to specific example embodiments, it will be appreciated, that it is intended to cover all modifications and equivalents within the scope of the appended claims.

What I claim is:

1. A detonator safety device having a safety position and a firing position, for a weapon including a main explosive charge, said detonator safety device comprising a detonator charge, a detonator member for firing said detonator charge, an igniter plate having a protecting function and an igniter function, said igniter plate being arranged between said detonator charge and said main explosive charge for transmitting a firing impact to said main explosive charge when said detonator safety device is in its firing position, and means for mounting said igniter plate in said safety position at a predetermined first distance (4') from said detonator charge, said predetermined first distance (4') being sufficient for preventing a transmission of said firing impact to said main explosive charge when said igniter plate is in said safety position, whereby said igniter plate performs said protecting function if said detonator charge should be accidentally fired in said safety position of said igniter plate to avoid firing the main explosive charge in said safety position, said detonator safety device further comprising means for providing a second distance (6) between said igniter plate and said main explosive charge in said firing position in which said igniter plate is enabled to perform said igniter function, wherein said mounting means permit resting said igniter plate on said main explosive charge in said safety position, and wherein said means for providing said second distance (6) comprise means for shifting said igniter plate out of said safety position away from said main explosive charge, toward said detonator charge in said firing position, whereby said igniter plate rests against said detonator charge in said firing position.

2. The detonator safety device of claim 1, wherein said igniter plate is a flying plate.

3. The detonator safety device of claim 1, wherein said means for providing said second distance comprise rack and pinion means including a toothed rack and a pinion gear, arranged for cooperation with said toothed rack for shifting said igniter plate from said safety position into said firing position.

4. The detonator safety device of claim 3, wherein said igniter plate is connected to said toothed rack at a point or along a line of predetermined, weakened strength for severing said igniter plate from said toothed rack when said detonator charge is fired.

5. The detonator safety device of claim 3, wherein said toothed rack rests said igniter plate on said main explosive charge in said safety position.

6. The detonator safety device of claim 3, wherein said detonator member is mounted on said pinion gear for moving said detonator member from said safety position to said firing position while simultaneously moving said igniter plate from said safety position into said firing position by the cooperation of said pinion gear with said toothed rack.

7. The detonator safety device of claim 3, wherein said igniter plate connected to said toothed rack rests on said main explosive charge in said safety position.

8. The detonator safety device of claim 3, further comprising locking means (11*a*, 11*b*) for locking said rack and pinion means against rotation in said safety position to prevent shifting said igniter plate into said firing position.

* * * * *